United States Patent [19]

Asaoka

[11] Patent Number: 5,007,459

[45] Date of Patent: Apr. 16, 1991

[54] HYDRAULIC CONTROL SYSTEM

[75] Inventor: Masaharu Asaoka, Saitama, Japan

[73] Assignee: Kayaba Industry Co. Ltd., Japan

[21] Appl. No.: 529,923

[22] Filed: May 29, 1990

[30] Foreign Application Priority Data

May 30, 1989 [JP] Japan ..... 1-62764[U]

[51] Int. Cl.[5] ..... F15B 13/044

[52] U.S. Cl. ..... 137/625.65; 91/451; 251/129.1; 251/129.15; 251/293

[58] Field of Search ..... 91/451; 137/625.65; 251/129.1, 129.15, 293

[56] References Cited

U.S. PATENT DOCUMENTS 4,565,219 1/1986 Kunogi ..... 137/625.65

4,782,859 11/1988 Constantinian ..... 137/596.2

*Primary Examiner*—Gerald A. Michalsky

*Attorney, Agent, or Firm*—Steinberg & Raskin

[57] ABSTRACT

A hydraulic control system capable of permitting an accessory component such as a port relief valve or the like to be mounted on a valve body. A cap member is interposedly arranged between a valve body and a solenoid, so that the valve body or the like and a casing of the solenoid or the like may prevented from interfering with each other when the accessory is mounted in the accessory port.

3 Claims, 1 Drawing Sheet

HYDRAULIC CONTROL SYSTEM

BACKGROUND OF THE INVENTION

This invention relates to a hydraulic control system, and more particularly to a hydraulic control system for changing over the position of a spool depending upon an excitation current of a solenoid.

A conventional hydraulic control system is generally constructed in such a manner as shown in FIG. 1. More particularly, the conventional hydraulic control system includes a valve body 1 formed with a spool hole 2 and a spool 3 slidably arranged in the spool hole 2. Also, the hydraulic control system includes a connection member 4 provided on one side of the valve body 1 and a solenoid S0 fixedly mounted on the outside of the connection member 4.

The solenoid S0 includes a casing 5, a coil arranged in the casing 5, and a fixed core 7 and a movable core 8 arranged on the inside of the coil 6 in a manner to be in series in the axial direction thereof. The connection member 4 is formed into substantially the same diameter as the casing 5 and formed at the central portion thereof with a spring chamber 9.

The conventional hydraulic control system further includes a push rod 10 which is fittedly mounted at one end thereof on one side of the movable core 8. Also, the other end of the push rod 10 extends through the spring chamber 9 of the connection member 4 to the end surface of the spool 3, resulting in being contacted with the end surface of the spool. Such construction causes the push rod 10 to force the spool 3 depending upon an excitation current of the solenoid S0.

The valve body 1 is formed on the side thereof facing the casing 5 with a positioning hole 11 serving as an accessory port. In the positioning hole or accessory port 11 is received an accessory such as a port relief valve or the like for selectively carrying out the communication between a return passage 12 and an actuator passage 13 each formed in the valve body 1.

In the conventional hydraulic control system constructed as described above, when an accessory such as a relief valve or the like is to be positioned in the positioning hole 11, the accessory and the connection member 4 interfere with each other. Thus, the conventional hydraulic system fails to successfully mount the accessory through the positioning hole 11 on the valve body 1.

In order to eliminate such a disadvantage, it is proposed to increase the length of the push rod 10 to secure a space sufficient to permit the accessory to be mounted therethrough on the system. Unfortunately, this causes an excessive increase in length of the push rod 10, resulting in the push rod 10 being obliquely deflected from the axial direction thereof when the push rod 10 is moved depending upon excitation of the solenoid. This leads to a failure in actuation of the solenoid.

Also, an excessive increase in length of the push rod 10 causes further disadvantages such as deformation of the push rod such as bending and damage of the push rod during transportation or the like.

SUMMARY OF THE INVENTION

The present invention has been made in view of the foregoing disadvantages of the prior art.

Accordingly, it is an object of the present invention to provide a hydraulic control system which is capable of permitting an accessory such as a port relief valve or the like to be mounted on a valve body.

It is another object of the present invention to provide a hydraulic control system which is capable of ensuring the safety of components of the system.

It is a further object of the present invention to provide a hydraulic control system which is capable of providing a space sufficient to ensure mounting of an accessory such as the relief valve or the like on a valve body while preventing an increase in length of the push rod.

It is still another object of the present invention to provide a hydraulic control system which is capable of effectively preventing a failure in actuation of a solenoid.

In accordance with the present invention, a hydraulic control system is provided which includes a valve body, a solenoid provided on one side of the valve body and including a movable core, a push rod arranged so as to be moved with the movable core of the solenoid, a spool arranged in the valve body and positioned opposite to the distal end of the push rod and positionally changed over depending upon an excitation current of the solenoid excited. The hydraulic control system has as a feature that an accessory port is formed on one side of the valve body for mounting an accessory component therethrough on the valve body, a cap member is detachably interposedly arranged between the valve body and the solenoid, and a push bar is arranged in the cap member so as to permit the push rod to be contacted at the distal end thereof through the push bar with the spool.

As described above, the hydraulic control system of the present invention is so constructed that the cap member is interposedly arranged between the valve body and the solenoid. Such construction permits a space of dimensions corresponding to the length of the cap member to be defined outside the accessory port. Also, the push bar is arranged in the cap member, through which the push rod of the solenoid is contacted with the spool, resulting in preventing an increase in length of the push rod.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1:
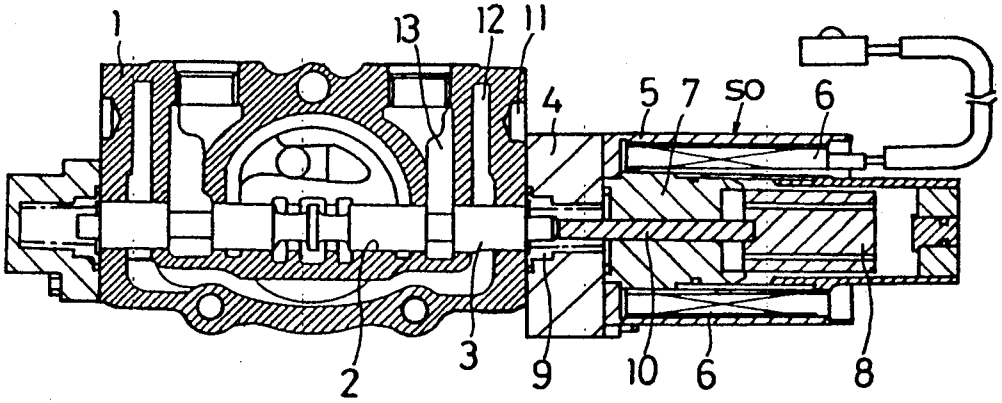
FIG. 1 (PRIOR ART)
FIG. 1 is a sectional view showing a conventional hydraulic control system.

Now, a hydraulic control system according to the present invention will be described with reference to FIG. 2 which shows an embodiment of the present invention.

A hydraulic control system of the illustrated embodiment includes a valve body 1 formed with a spool hole 2, a spool 3 slidably arranged in the spool hole 2 and a solenoid S0, as in the conventional hydraulic control system.

The hydraulic control valve of the embodiment includes a cap member 14, through which the solenoid S0 is mounted on one side of the valve body 1. The solenoid S0 per se is constructed in substantially the same manner as that of the conventional hydraulic control system described above. The solenoid S0 includes a casing 15, a coil 16 arranged in the casing 15, and a fixed core 17 and a movable core 18 arranged inside the coil 16 in a manner to be in series in the axial direction of the solenoid S0. The cap member 14 is formed at the central portion thereof with a spring chamber 19.

The cap member 14 is formed on one side thereof with a flange section **14*a* of substantially the same diameter as that of the casing 15 and on the other side thereof with a mounting seat 14*b* having a diameter smaller than that of the flange section 14*a*. The cap member 14 is mounted through the mounting seat 14*b* on the one side of the valve body 1, and the solenoid S0 is fixed on the outer surface of the flange section 14*a***.

The above-described arrangement of the cap member 14 in a manner to be interposed between the valve body 1 and the solenoid S0 permits a space 21 of dimensions corresponding to the cap member 14 to be defined on the outside of an accessory port 20 for an accessory component such as a port relief valve or the like.

Also, the cap member 14 is formed at the central portion thereof with a hole 22 so as to extend in the axial direction thereof. The axial hole 22 is arranged in a manner to be communicated at one end thereof with the spring chamber 19 and oppositely at the other end thereof to a push rod hole 23 formed at the fixed core 17. In the axial hole 22 is slidably arranged a push bar 24.

In the movable core 18 of the solenoid S0 is fittedly mounted a push rod 25 in such a manner that both are integral with each other. The push rod 25 extends at the other end thereof through the push rod hole 23 to one end of the push bar 24, resulting in being contacted with the push bar 24. The push bar 24 is arranged so as to be contacted at the other end thereof with the surface of the end of the spool 3 arranged so as to project into the spring chamber 19.

Figure 2:
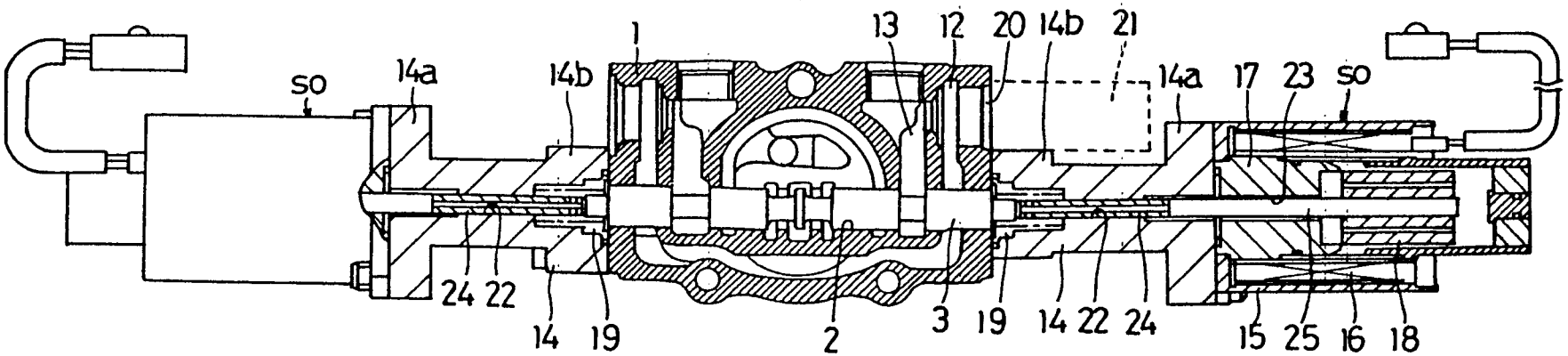
FIG. 2 is a sectional view showing an embodiment of a hydraulic control system according to the present invention.

In the hydraulic control system constructed as described above, when the solenoid S0 is excited, the spool 3 is moved in the left direction in FIG. 2 depending upon an excitation current of the solenoid, so that the position of the spool may be changed over.

As described above, in the illustrated embodiment, the cap member 14 is arranged between the valve body 1 and the solenoid S0 and formed on one side thereof with the flange section **14*a* of the same diameter as the casing 15 of the solenoid S0 and on the other side thereof with the mounting seat 14*b* of a diameter smaller than the flange section 14*a* through which the cap member 14 is fastened onto one side of the valve body. Thus, the space 21 may be effectively defined outside the accessory port 20**.

Also, the push bar 24 is slidably arranged in the cap member 14, through which the push rod 25 of the solenoid S0 is contacted with the spool 3. Such construction permits the length of the push rod 25 to be kept small as in the prior art. This effectively prevents the push rod 25 from being obliquely deflected from the axis thereof, resulting in preventing a failure in operation of the solenoid. Further, this positively prevents deformation of the push rod such as bending and breakage of the push rod during the transportation or the like.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

I claim:

1. A hydraulic control system comprising:

a valve body;

a solenoid provided on one side of said valve body and including a movable core;

a push rod arranged so as to be moved with said movable core of said solenoid;

a spool arranged in said valve body and positioned opposite to the distal end of said push rod;

said spool being positionally changed depending upon an excitation current of said solenoid;

an accessory port formed on one side of said valve body for mounting an accessory component therethrough on said valve body;

a cap member detachably interposedly arranged between said valve body and said solenoid, said cap member abutting said one side of said valve body and having a diameter sufficiently smaller than said valve body so as to not obstruct said accessory port; and a push bar insertedly arranged in said cap member so as to permit said push rod to be contacted at the distal end thereof through said push bar with said spool.

2. A hydraulic control system as defined in claim 1, wherein said cap member is formed on one side thereof facing said solenoid with a flange section and on the other side thereof with a mounting seat.

3. A hydraulic control system as defined in claim 2, wherein said flange section is formed into substantially the same diameter as said solenoid and said mounting seat is formed into a diameter smaller than said flange section.

* * * * *